US005353445A

United States Patent [19]

Denzin

[11] Patent Number: 5,353,445

[45] Date of Patent: Oct. 11, 1994

[54] CONDUIT ATTACHMENT SYSTEM

[75] Inventor: Peter W. Denzin, Glenbeulah, Wis.

[73] Assignee: Kohler Co., Kohler, Wis.

[21] Appl. No.: 17,589

[22] Filed: Feb. 16, 1993

[51] Int. Cl.[5] ..... E03D 1/34

[52] U.S. Cl. ..... 4/378; 4/404; 285/86; 285/162

[58] Field of Search ..... 4/378, 392, 393, 395, 4/403, 404, 417, 418; 285/86, 162, 194, 205

[56] References Cited

U.S. PATENT DOCUMENTS

| | | | |
|---|---|---|---|
| 2,514,504 | 7/1950 | Moline | 248/56 |
| 2,841,418 | 7/1958 | Keating et al. | 285/194 |
| 3,243,206 | 3/1966 | Samer | 285/162 |
| 3,269,602 | 8/1966 | Weber, III | 285/162 X |
| 3,514,129 | 5/1970 | Holdren | 285/162 |
| 4,074,912 | 2/1978 | Van Bilderbeek et al. | 285/86 X |
| 4,433,446 | 2/1984 | Grimstad | 4/378 |
| 4,462,620 | 7/1984 | Bambenek et al. | 285/162 |
| 4,500,117 | 2/1985 | Ayers et al. | 285/86 X |

*Primary Examiner*—Robert M. Fetsuga
*Attorney, Agent, or Firm*—Quarles & Brady

[57] ABSTRACT

An assembly for connecting a plumbing conduit to a wall is disclosed. In one aspect there is an outlet formed in a wall of the tank and a resilient seal bearing against an inner surface of the wall around the outlet. The seal has a bore aligned with the outlet. A connector tube sandwiches the seal against the wall and also extends through the bore and outlet. The connector is held in place by a radially outwardly extending flange and a locking ring inside the connector.

7 Claims, 3 Drawing Sheets

CONDUIT ATTACHMENT SYSTEM

FIELD OF THE INVENTION

The present invention relates to plumbing connectors that direct liquid through a wall. It appears especially useful in connection with flush valve assemblies to be mounted at the bottom of a toilet tank.

DESCRIPTION OF THE ART

U.S. Pat. No. 4,433,446 describes a flush valve that can be mounted at the bottom of the tank on the outlet, without requiring access to the underside of the tank wall. However, this flush valve requires that a non-circular outlet be formed in the tank bottom. It would be advantageous to avoid the need for such a non-circular hole (to reduce labor/manufacturing costs), while at the same time keeping the ability to install the valve without access to the tank wall underside.

Similarly, some contemporary flushing assemblies employ an electric pump that pumps water from the tank to the bowl through a tank side wall. The pump outlet hose is located in the toilet tank, and must be securely fixed in the tank side wall and sealed against the wall to prevent leakage. Again, it is desirable to avoid the need for a non-circular hole in the side wall (or systems that require access to both sides of the wall).

SUMMARY OF THE INVENTION

The present invention resides in an attachment assembly for connecting a plumbing conduit to a wall. In one embodiment, there is an outlet formed in the wall and a resilient seal bearing against the wall. The seal surrounds the outlet and has a seal bore aligned therewith.

There is also a connector positionable in the seal bore and outlet. When so positioned, the connector has a radially outwardly extending flange positionable inboard of the seal to trap the seal against the wall. The connector also has an extension member that extends axially through the seal bore and outlet, the extension member having a radially outwardly extending external flange on its outboard end.

The extension member is radially compressible between an assembly position in which the extension can pass through the outlet while the connector is centrally aligned therewith, and a normal rest position in which the extension member can inhibit inboard motion of the connector through the outlet. There is also provided a blocking member receivable within the connector so as to assist in maintaining the extension member in the rest position.

In one aspect, the blocking member may take the form of a ring which is retainable in the connector by the interfitting of a projection on the ring and a recess inside the connector. The extension member may also have a radially inwardly extending flange that limits the outboard movement of the ring inside the connector.

In another embodiment of the invention, the connector is in the form of a flush valve seat with an adjacent overflow conduit. In this embodiment, the assembly has a resilient seal positionable against an interior side of a toilet wall such that the seal surrounds the outlet. The seal also has a central bore which is alignable with the outlet. A flush valve housing is positionable in the seal bore and outlet. The housing has a flange extending radially outwardly to trap the seal against the wall when the valve and seal are installed in the tank. The housing also has a resilient extension member that extends through the seal bore and outlet, the extension member having a flange that extends radially outward on the exterior side of the wall.

The extension member is radially compressible between an assembly position in which the extension member can pass through the outlet and a locking position in which a flange can catch on the exterior side of the wall. A ring is receivable within the housing so as to maintain the extension member in the locking position.

In yet another embodiment, the connector is positioned in a toilet tank and the inward end of the connector is connected to a pump outlet conduit.

As will be apparent from the description below, the present invention allows a user to easily install a pump tube, flush valve housing or other type of plumbing conduit to a wall by placing a seal around an outlet hole, pushing an extension member through the seal and outlet, and inserting a blocking member. The user need not have any access to the underside of the tank bottom wall to install the system. Moreover, the outlet hole need not be specially adapted or altered to secure the assembly.

The objects of the invention therefore include providing an attachment assembly of the above kind:

a) which can be attached to a blind hole formed in a tank wall;

b) which is inexpensive to produce and install, and can be used by a consumer who has little training in plumbing techniques; and c) which provides a water tight seal.

The foregoing and other objects and advantages of the invention will appear from the following description. In the description, reference is made to the accompanying drawings which for a part hereof, and in which there is shown by way of illustration preferred embodiments of the invention. Such embodiments do not represent the full scope of the invention. Reference is made therefore to the claims herein for interpreting the full scope of the invention.

DESCRIPTION OF THE PREFERRED EMBODIMENTS

Figure 1:
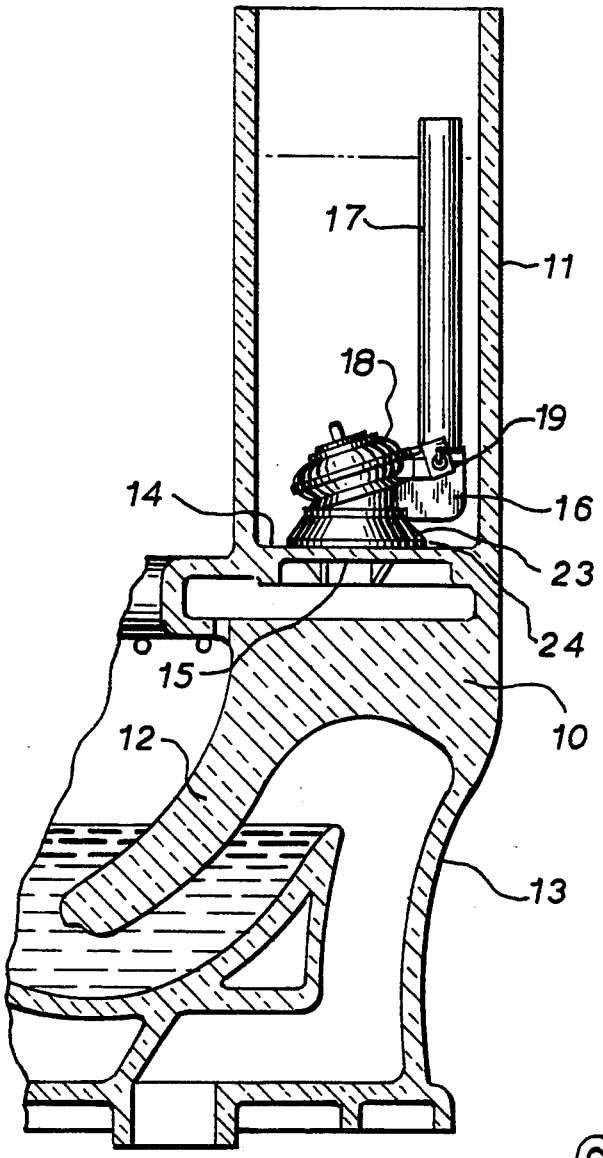
FIG. 1 is a view of a one-piece toilet, partially in section, in which has been installed a flush valve assembly embodying the present invention.

Referring now to FIG. 1 of the drawings, a "one-piece" type toilet 10 consists of a tank portion 11, a bowl portion 12 and the usual syphon portion 13. As is conventional with such toilets, the tank has a bottom wall 14, and an outlet hole 15 formed in the bottom wall 14.

A flush valve assembly, referred to generally by numeral 16, includes a conventional overflow tube 17, and a conventional flapper 18 attached onto conventional hooks 19 on the sides of the tube 17. The flapper 18 is moved onto and off its seat by one of the many known trip mechanisms (not shown). When the tank is filled, the flapper will be in the position shown in FIG. 1. When water is to be let out of the tank, the flapper will be lifted off its seat (usually through use of a chain attached to the top of the flapper).

Figure 2:
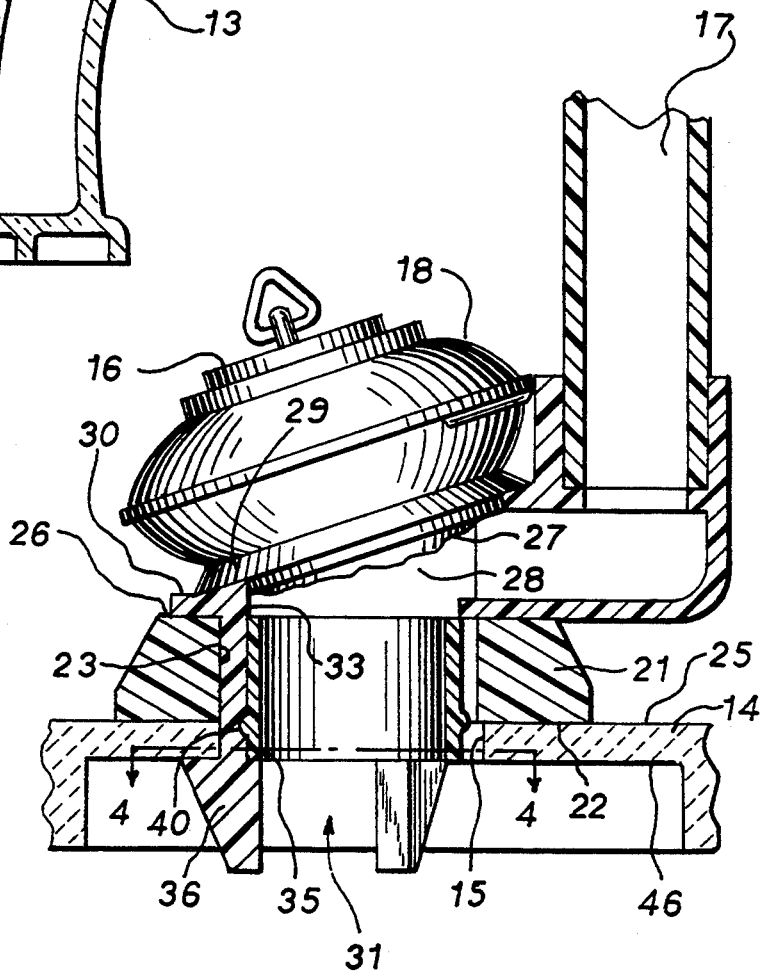
FIG. 2 is an enlarged view, partially in section of a flush valve attachment system embodying the present invention.
Figure 3:
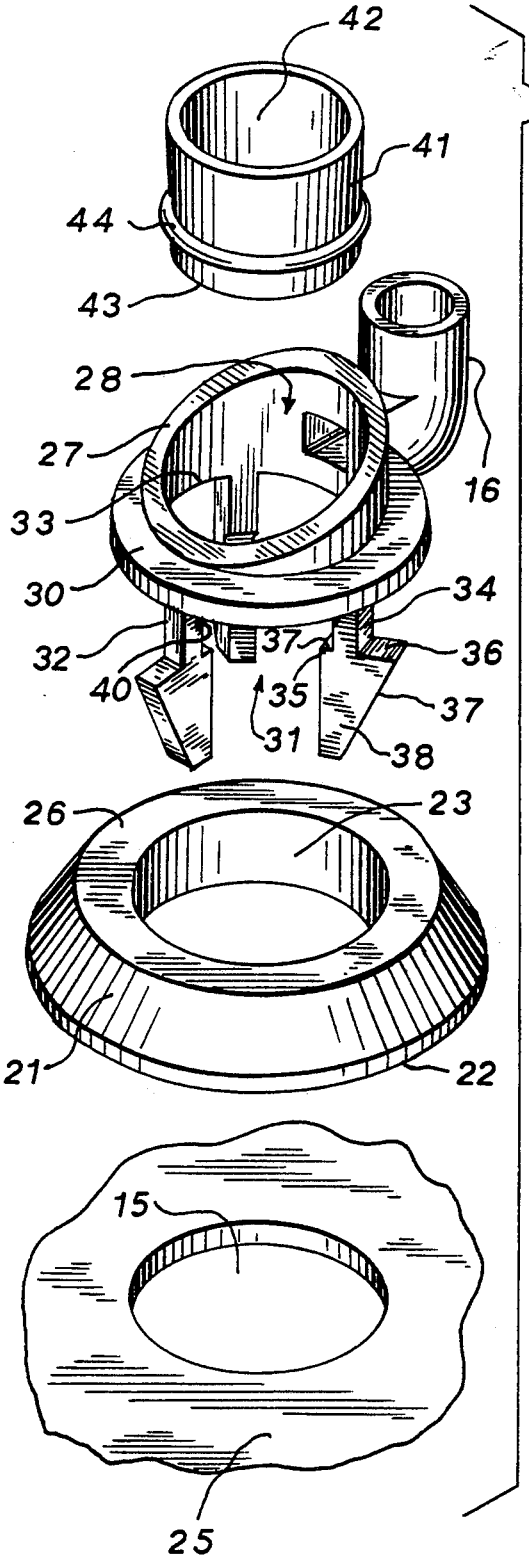
FIG. 3 is an exploded perspective view of the flush valve attachment system shown in FIG. 2.

Referring now to FIGS. 2 and 3, a resilient, axially compressible seal 21, is also provided. It has both a lower 22 and an upper 26 sealing surface and a seal bore 23. As shown in FIG. 2, the lower sealing surface 22 bears against the top side or inward surface 25 of the tank bottom wall 14. The seal 21 can then surround and seal the outlet 15 when the bore 23 is aligned over the outlet 15.

The flush valve 16 has a valve seat 27 above the upper surface 26 of the compressible seal 21. This seat 27 has an outlet channel 28 therethrough. The edge 29 of the valve seat 27 is preferably sloped. A flange 30 extends radially outwardly from above the seal 21, so as to compress and trap the seal 21 against the interior surface 25 of the tank bottom wall 14.

As best shogun in FIG. 3, three extension legs 32 are circumferentially equispaced around the rim 33 of the channel 28 and can extend downward through the seal bore 23 and outlet 15. The legs 32 in turn define a central region 31 concentric with the channel 28.

Each leg 32 is comprised of a resilient knee 34, a radially inwardly extending heel 35, a radially outwardly extending foot 36 and a sloped cam 37. The heel 35 and foot 36 define extension 38. On the internal surfaces of each knee 34, a small horizontal recess 40 is provided. This recess 40 operates in conjunction with an annular locking rib 44 on ring 41 to maintain the ring 41 in a single longitudinal position.

Referring again to FIG. 2, it can be seen that each foot 36 extends radially outward of bore 23. This prevents the seal 21 from easily falling off the extension members 32 (and being lost) when the assembly is stored or shipped. It also allows easy handling of the assembly when being installed.

Referring again to FIG. 3, the ring 41 is a cylindrical member having a hollowed-out internal passageway 42. Near the lower edge 43 of the snap ring 41, an annular locking rib 44 is provided around the outer circumference of the snap ring 41. The snap ring 41 is sized so that it is generally slidably receivable within the housing channel 28 and central bore 31. Its rib 44 extends radially outwardly from the snap ring 41 and should effect a tight fit within the central bore 31 when partially inserted, and a secure snap fit when fully inserted inside the recess 40.

To install the flush valve assembly 16, the seal 21 is first placed over the extensions 38 so that the upper sealing surface 26 is in full contact with the flange 30. Damage to the seal 21 during installation can be minimized by bending the projections 32 radially inward while passing the seal 21 over the extensions 38. The knees 34, being resilient, can be temporarily deformed to facilitate assembly.

Next, the extension members 32 are pushed through the outlet hole 15 so that the seal 21 is compressed by the flange 30 against the internal surface 25 of the wall 14. To facilitate easy installation, the sloped external surfaces 37 of the extensions 38 can be placed in contact with the rim of the outlet 15. By pushing downward on the housing 27, the knees 34 are compressed radially inward until the extensions 38 have passed through the outlet hole 15.

Once through the outlet hole 15, the resilient property of the knees 34 will return extensions 38 to their original rest position. The foot 36 of each extension member 32 will be in contact with the bottom surface 46 of the tank wall 14 (seen in FIG. 2). Next, the snap ring 41 is pushed into the central bore 31 entirely between the knees 34 until movement of the snap ring 41 is restrained by the heels 35 (see FIG. 2).

Figure 4A:
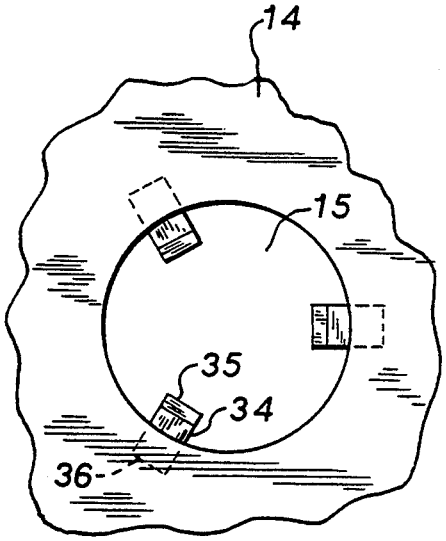
FIG. 4A is a view taken along lines 4—4 of FIG. 2 (albeit without the snap ring in place)
Figure 4B:
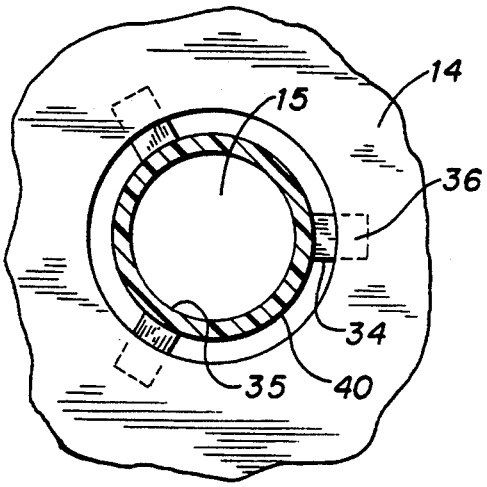
FIG. 4B is a view similar to FIG. 4A, which shows the flush valve attachment system having the snap ring in place.

FIGS. 4A and 4B illustrate how the snap ring 41 locks the assembly in place. After the snap ring 41 is inserted, the knees 34 are prohibited from inward radial deformation and hence are in secure contact with the outlet 15.

Figure 5:
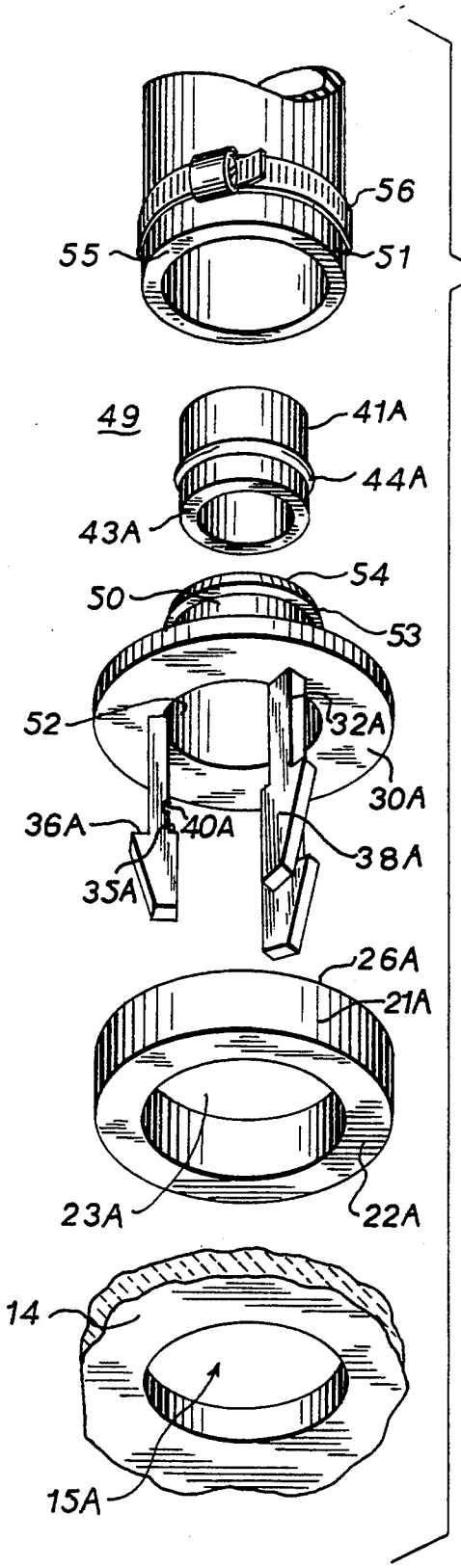
FIG. 5 is an exploded perspective view a second embodiment of the present invention.
Figure 6:
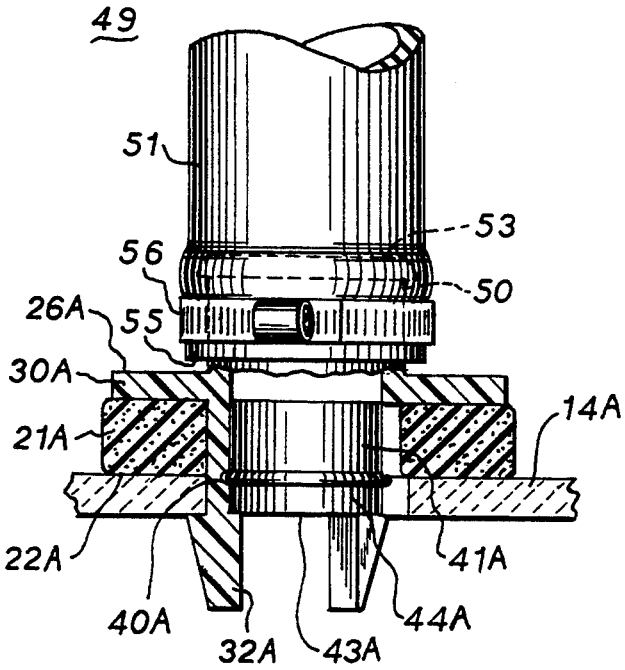
FIG. 6 is a plan view of the second embodiment of the present invention in assembled form.

Referring now to FIGS. 5 and 6, there is shown a pump hose attachment assembly (referred to generally as 49) which is a second embodiment of the present invention. Most of the features of the second embodiment are analogous to those of the first embodiment. For convenience in studying the second embodiment, those parts of the second embodiment which are common to the first embodiment are identified by the same reference numerals which identify the corresponding parts of the first embodiment, albeit with an "A" listed thereafter.

Among the parts unique to the second embodiment is a connection cylinder 50 in place of the valve seat 27. The cylinder 50 is integrally attached to and extends upward from the flange 30A a sufficient distance to allow a secure connection to be made with a pump tube 51. The cylinder 50 has an internal passageway 52 through which water is directed from the pump tube 51 to the outlet 15A. A radially outwardly extending rim 53 is provided around the upper edge 54 of the cylinder 50.

Referring to FIG. 6, after installation of the attachment assembly 49, a screw clamp 56 is slid over the pump tube 51 and the pump tube 51 is forced over the rim 53 until the lower edge 55 of the tube 51 is in contact with the flange 30A. The screw clamp is tightened around the tube 51, radially compressing the tube 51 around the connection cylinder 50 between the rim 53 and the flange 30A.

It will be appreciated that in addition to the specific embodiments shown, the invention can appear in other embodiments. For example, it is not critical that there be three extension members 32. One may suffice. Nor is it critical that the assembly be placed on the bottom wall of the tank. A side wall may also prove suitable (and is in fact preferred for pump toilet applications). In addition, the wall need not be of a toilet tank. Various plumbing tanks, enclosures, fixtures and fittings may provide the outlet. Furthermore, the flange 30 need not be a continuous rim. Instead, it could be one or more projections. Thus, there may be various modifications and changes in embodiments which have been shown which are within the scope of the invention. Such modifications and changes are meant to be within the scope of the invention. As such, the invention is not to be limited by the illustrative description above.

I claim:

1. An assembly for connecting a plumbing conduit to a wall, the wall having an aperture formed therein, the assembly comprising:

a resilient seal adapted to bear against the wall so as to surround the aperture and have a bore aligned with the aperture;

a connector positionable in the bore and aperture when the seal bears against the wall, and when so positioned having:

a first radially outwardly extending flange positionable inboard from the seal to trap the seal against an inboard side of the wall;

an extension member that can extend axially through the seal bore and wall aperture, the extension member having a second radially outwardly extending flange on its outboard end; and said extension member being radially compressible between an assembly position in which the extension member can pass through the aperture and a normal rest position in which the second radially outwardly extending flange is adapted to contact an outboard side of the wall and can inhibit inboard motion of the extension member through the aperture; and a blocking ring receivable within the connector adjacent the extension member so as to assist in maintaining the extension member in its rest position, the extension member having a first fastener element and the blocking ring having a second fastener element, the first and second fastener elements cooperating to retain the ring in a locked position adjacent the extension member;

wherein the extension member also has a radially inwardly extending flange outboard of the blocking ring that limits outboard movement of the blocking ring inside the connector.

2. The assembly of claim 1, wherein the first fastener element is a recess and the second fastener element is a protection receivable in said recess.

3. The assembly of claim 1, wherein the resilient seal is adapted to bias the second extending flange tightly against the outboard side of the wall.

4. The assembly of claim 1, wherein the inboard end of the connector is in the form of a flush valve seat with an adjacent overflow conduit.

5. The assembly of claim 1, wherein the connector is suitable to be positioned in a toilet tank with the inboard end of the connector being connected to a pump outlet conduit and the wall being a wall of a toilet tank.

6. A flush valve assembly connectable to a wall of a toilet tank, the wall having an outlet formed therein, the assembly comprising:

a resilient seal positionable against an interior side of the wall such that the seal surrounds the outlet, the seal also having a central bore which is alignable with the outlet;

a flush valve housing positionable in the seal bore and the outlet, the housing having a first flange extending radially outwardly inboard of the seal to trap the seal against the wall when the valve and seal are installed in the tank, the housing also having a resilient extension member that can extend through the seal bore and outlet, the extension member having a second flange that can extend radially outwardly on the exterior side of the wall;

said extension member being radially compressible between an assembly position in which the extension member can pass through the outlet and a locking position in which the second flange can catch on the exterior side of the wall; and a blocking ring receivable within the housing adjacent the extension member so as to assist in maintaining the extension member in its rest position, the extension member having a first fastener element and the blocking ring having a second fastener element, the first and second fastener elements cooperating to retain the ring in a locked position adjacent the extension member;

wherein the extension member also has a radially inwardly extending flange outboard of the blocking ring that limits outboard movement of the blocking ring inside the connector.

7. The flush valve assembly of claim 6, wherein the housing includes a plurality of such extension members, each extension men,bet being extendable through the seal bore and outlet, and each extension member having a radially extending flange at its distal end.

* * * * *

UNITED STATES PATENT AND TRADEMARK OFFICE

CERTIFICATE OF CORRECTION

PATENT NO. : 5,353,445

DATED : October 11, 1994

INVENTOR(S) : Peter W. Denzin

It is certified that error appears in the above-indentified patent and that said Letters Patent is hereby corrected as shown below:

Column 2,, line 35, "which for" should be --which form--.

Column 3, line 26, "best shogun" should be --best shown--.

Column 5, line 37, "protection" should be --projection--.

Column 6, line 40, "men,bet" should be --member--.

Signed and Sealed this

Twenty-first Day of February, 1995

*Attest:*

Bruce Lehman

BRUCE LEHMAN

*Attesting Officer*

*Commissioner of Patents and Trademarks*